US005957454A

United States Patent [19]

Libeskind

[11] Patent Number: 5,957,454

[45] **Date of Patent: *Sep. 28, 1999**

[54] JIGSAW PUZZLES

[76] Inventor: Yves Libeskind, 27 rue Damrémont, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,029

[22] Filed: Jun. 4, 1997

Related U.S. Application Data

[63] Continuation of application No. PCT/FR95/01659, Dec. 13, 1995.

[30] Foreign Application Priority Data

Dec. 14, 1994 [FR] France ..... 94 15073

[51] Int. Cl.[6] ..... A63F 9/10

[52] U.S. Cl. ..... 273/157 R

[58] Field of Search ..... 273/157 R, 153 R, 273/156, 157 A

[56] References Cited

U.S. PATENT DOCUMENTS

| | | | |
|---|---|---|---|
| 2,953,380 | 9/1960 | Hassenbach | 273/157 R |
| 4,007,555 | 2/1977 | Sasaoka | 273/157 R |
| 4,792,138 | 12/1988 | Watkins | 273/157 R |
| 4,830,376 | 5/1989 | Hillis | 273/157 R |
| 5,022,655 | 6/1991 | Meyer | 273/157 R |
| 5,149,570 | 9/1992 | Cain | 273/153 R |
| 5,230,508 | 7/1993 | Tabler | 273/157 R |

*Primary Examiner*—Steven B. Wong
*Attorney, Agent, or Firm*—Oppedahl & Larson LLP

[57] ABSTRACT

A jigsaw puzzle is made up from a plurality of pieces which can be assembled to form a picture. The pieces include a plurality of outer edge pieces which when assembled establish a perimeter of the puzzle and a plurality of interior pieces. The pieces are formed by cutting a support bearing the picture along a plurality of cutting lines extending in two approximately orthogonal directions within a plane defined by the support. This results in a puzzle in which each piece lies at an intersection of a row and a column and each edge of each piece contacts only one edge from a single other piece in the assembled puzzle. The pieces are locked together by means of a plurality of male and female interlocking elements, which are part of the edges of the different pieces. The puzzle of the invention is made more difficult because the cutting lines include a variable number of straight segments such that at least half of the interior pieces, and preferably all of these pieces, each have at least one straight edge. To ensure that the puzzle locks together, the straight segments are arranged in such a way that they do not define any closed polygonal line, i.e. any polygon within the perimeter of the puzzle nor any polygonal line joining two separate points on the perimeter of the puzzle.

19 Claims, 7 Drawing Sheets

JIGSAW PUZZLES

This application is a continuation of PCT Patent Application No. PCT/FR95/01659, filed Dec. 13, 1995 designating the United States.

BACKGROUND OF THE INVENTION

The present invention relates to the kind of puzzles generally known as jigsaw puzzles, consisting of a plurality of pieces which can be assembled to form a picture, first applied on a support, the whole being cut afterwards into pieces. This picture represents any kind of scene, generally the reproduction of a painting, a drawing, or a photograph.

More particularly, the present invention relates essentially to jigsaw puzzles cut by a number of lines extending into two directions in the puzzle plane, approximately orthogonal to each other, in which the pieces are arranged in such a way that each piece is placed in a position at the intersection of a row and a column, so that each of its four edges can be directly in contact with only one edge from a single other piece. Each piece of the puzzle is therefore adjacent to at most four other pieces. Generally, the cutting lines are slightly irregular, a reminiscence of the time when puzzles were cut manually, but the pieces can be also cut in a perfectly regular way.

Still more particularly, the present invention relates to jigsaw puzzles in which the pieces are not only placed side-by-side, but also are joined together by means of a plurality of male and female interlocking elements, which are part of the edges of the different pieces, and ensure that each part of the puzzle remains attached to the whole in the puzzle plane, no other means being necessary to this end, so that the pieces can be only assembled and disassembled in a direction outside the puzzle plane. In most cases, two adjacent pieces are joined together by a male element, which is part of the edge of the first piece, and a female element, which is part of the edge of the second piece, these elements, generally of rounded shape, ensuring that the two pieces remain interlocked. In a very few cases, two adjacent pieces are joined together by several male and several female interlocking elements. In some cases, the cutting line between two adjacent pieces is just irregular, the other pieces ensuring that these two pieces remain attached together. Traditionally, the arrangement of these male and female elements is free, the different pieces having a variable number of male elements and a variable number of female elements, but, in many cases, the male elements alternate with the female elements, for practical reasons.

Some pieces of the puzzle, named outer edge pieces, form the border of the puzzle, some edges of these pieces defining the perimeter of the puzzle. In most cases, this perimeter is of rectangular shape, which only makes possible a true representation of a rectangular picture, as well as an easy framing of the puzzle once assembled, but this perimeter can be also of any other shape. The other pieces, named interior pieces, form the interior part of the puzzle. Generally, such a rectangular puzzle comprises ($m \times n$) pieces, including ($2 \times (m+n)-4$) outer edge pieces, each having one straight edge, except the four corner pieces, each having two adjacent straight edges, and ($(m-2) \times (n-2)$) interior pieces, without any straight edge.

Traditionally, when puzzles where cut manually, the cutting style was not always well defined, but, on the contrary, could be free and irregular. For example, the cut would follow the line separating two sections of the picture with different colors, the only help to assemble the puzzle being the shape of the pieces. Today, the mass production of puzzles is mechanized and standardized. The same die is generally used to cut different puzzles, representing all kinds of pictures. The difficulty of assembling of such a puzzle depends essentially on the number of pieces, the average size of the pieces, and the complexity of the picture itself.

Another approach to increase the difficulty of assembling of a puzzle is disclosed in U.S. Pat. No. 5,022,655, in which the cutting lines of the puzzle include one or several rectangles, or more generally one or several polygons, so as to add new straight edge pieces on both sides of these rectangles, or polygons, as well as new corner pieces with two straight edges. As the outer edge pieces are not any more distinguishable, by their shape, from these interior pieces, a result of this approach is to make the assembling of a puzzle slightly more difficult.

However, in practice and in any of its different embodiments, this approach requires a certain number of traditional interior pieces without any straight edge, which does not make it possible for this patent to meet its objective entirely and really increase the difficulty of assembling of a puzzle. Moreover, a major disadvantage of this approach is to produce a puzzle made of several separated parts, that are not attached to each other, which results in the weakening of the structure of the puzzle. In order to solve this problem, this patent suggests to join the different separated parts of the puzzle by a number of special "joiner" pieces, made of two ordinary pieces joined together, crossing the boundaries between these different parts. The use of similar double pieces has been suggested before in French Pat. No. 2,395,051, as a way to join two puzzles placed side by side to form a larger puzzle. This technique, even if it provides a minimum way to ensure that the different parts of the puzzle remain attached to each other, is nevertheless artificial, as it requires the use of double pieces, completely different by their nature from the other puzzle pieces. For all these reasons, the approach described in this patent is not entirely satisfactory.

SUMMARY OF THE INVENTION

In accordance with the invention a jigsaw puzzle is provided comprising a plurality of pieces which can be assembled to form a picture. The pieces include a plurality of outer edge pieces which when assembled establish a perimeter of the puzzle and a plurality of interior pieces. The pieces are formed by cutting a support bearing the picture along a plurality of cutting lines extending in two approximately orthogonal directions within a plane defined by the support. This results in a puzzle in which each piece lies at an intersection of a row and a column and each edge of each piece contacts only one edge from a single other piece in the assembled puzzle. The pieces are locked together by means of a plurality of male and female interlocking elements, which are part of the edges of the different pieces. The puzzle of the invention is made more difficult because the cutting lines include a variable number of straight segments such that at least half of the interior pieces, and preferably all of these pieces, each have at least one straight edge. To ensure that the puzzle locks together, the straight segments are arranged in such a way that they do not define any closed polygonal line, i.e. any polygon, within the perimeter of the puzzle nor any polygonal line joining two separate points on the perimeter of the puzzle.

DETAILED DESCRIPTION OF THE INVENTION

Figure 1:
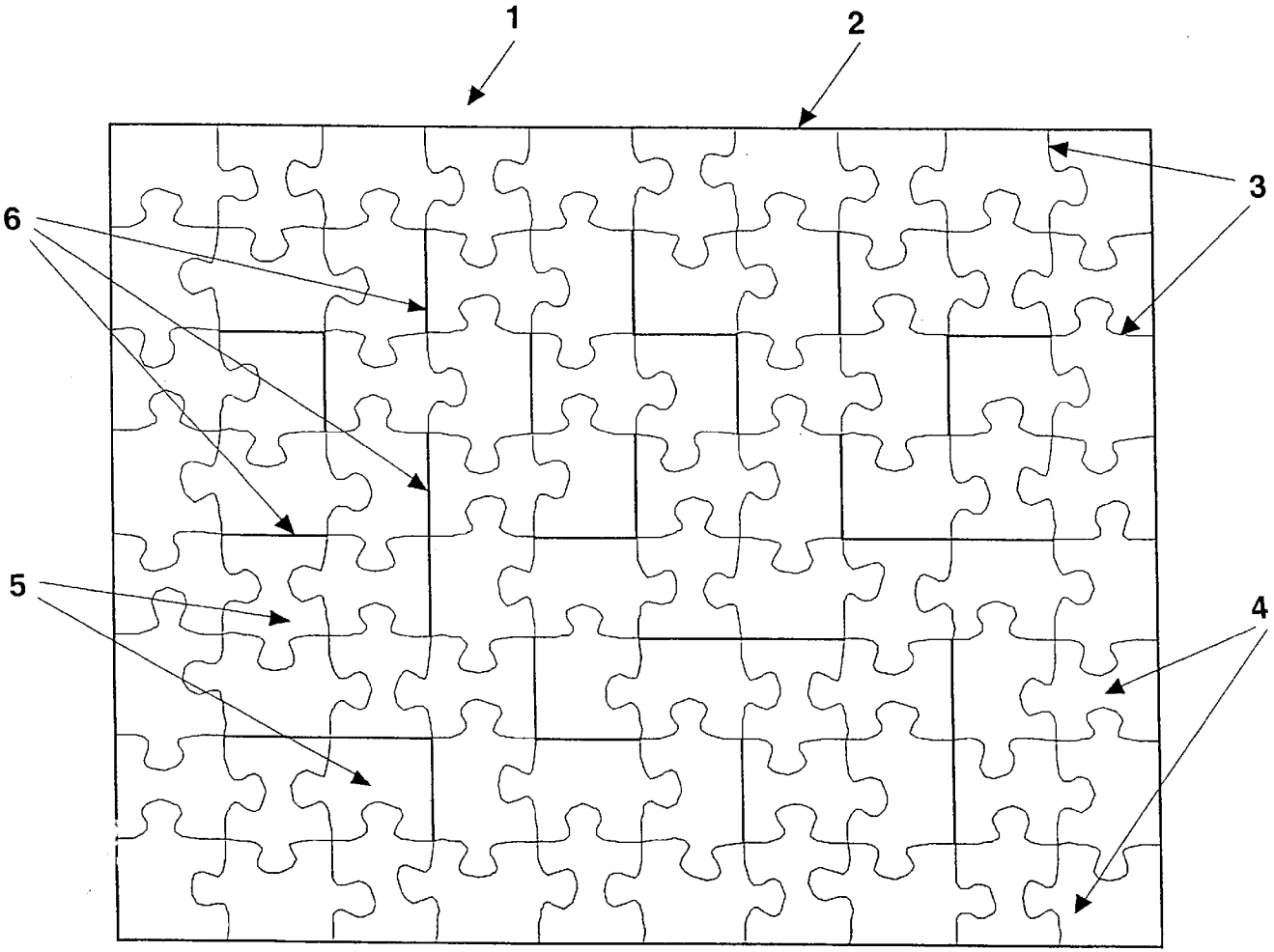
FIG. 1 shows a first embodiment of a puzzle in accordance with the invention.

The main objective of the present invention is to make the assembling of a puzzle really more difficult, and therefore more interesting, and to preserve at the same time the main characteristics of a puzzle, as defined above. To this end, it provides an innovative technique puzzle that is more efficient and more satisfactory than the techniques disclosed up to now.

According to the present invention, the cutting lines of the puzzle include a variable number of straight segments, such that at least half of the interior pieces of the puzzle each have at least one straight edge. These straight segments are arranged in such a way that they do not define, within the perimeter of the puzzle, any closed polygonal line, i.e., any polygon, nor any polygonal line joining two separate points on the perimeter of the puzzle.

According to a specific embodiment of the invention, all of the interior pieces of the puzzle each have at least one straight edge.

According to another specific embodiment of the invention, all of the pieces of the puzzle, outer edge pieces and interior pieces, each have at least one straight edge.

According to another specific embodiment of the invention, all of the interior pieces of the puzzle each have, either one single straight edge, for a part of these pieces, or two adjacent straight edges forming an angle, for the rest of these pieces.

According to another specific embodiment of the invention, all of the interior pieces of the puzzle each have one single straight edge.

According to another specific embodiment of the invention, some outer edge pieces have at least one interior straight edge which makes contact with an edge from an interior or outer edge adjacent piece.

According to another specific embodiment of the invention, the only puzzle pieces having at least one straight edge are interior pieces.

According to still another specific embodiment of the invention, the straight segments are arranged in a regular way, as a result of the repetition of one or more patterns.

According to a last specific embodiment of the invention, all or part of the straight segments are highlighted, either in a direct way, these segments being emphasized with lines forming an integral part of the picture, or in an indirect way, these segments defining the outlines of sections of the picture having different colors.

A first result of the present invention is to make the assembling of a puzzle really more difficult. The traditional method, which includes as a first and generally easy step, the assembling of the border of the puzzle, so as to delimit its outer edge, before continuing the assembling towards the interior of the puzzle, is now less efficient, or even not operational any more. In some cases, the assembling of the border of the puzzle can be completed only at a late stage, or even at the final stage. The invention clearly shows that it is possible to design a puzzle comprising an important proportion, as large as it is desirable, of interior pieces each having at least one straight edge, to the total number of interior pieces. This proportion can therefore represent the whole of these pieces, no traditional interior pieces without any straight edge being necessary. This situation, where all the interior pieces of the puzzle each have at least one straight edge, represents the most satisfactory embodiment of the present invention, as it makes it possible for the invention to meet entirely its initial objective, which is to make the assembling of a puzzle really more difficult. Naturally, it is also possible to leave a certain number of traditional interior pieces without any straight edge, as it is clear that a small quantity of such pieces would not alter substantially the nature of the invention. According to the invention, it is also possible to design a puzzle in which some edges from the outer edge pieces, other than the edges defining the perimeter of the puzzle, are straight, which could represent an additional difficulty. Finally, according to the invention, it is possible to design a puzzle in which the only puzzle pieces having at least one straight edge are not outer edge pieces, but interior pieces, which is a particularly unusual situation.

Another important result of the present invention is to preserve, in any of its different embodiments, the main characteristics of a puzzle, as defined above, and in particular, to ensure that each part of the puzzle remains attached to the whole in the puzzle plane, so that the pieces can be only assembled and disassembled in a direction outside the puzzle plane. According to the invention, the straight segments, which are part of the cutting lines of the puzzle, are arranged in such a way that they do not define, inside the perimeter of the puzzle, any closed polygonal line, I. e. any polygon, nor any polygonal line joining two separate points on the perimeter of the puzzle. This makes possible for each part of the puzzle to remain attached to the whole in the puzzle plane by means of a plurality of male and female interlocking elements, which are part of the edges of the different pieces, so that each piece is joined to at least one other piece, as specified above. This result is obtained without using any other means such as, for example, double or "joiner" pieces. As specified above, each piece is placed in a position at the intersection of a row and a column, so that each of its four edges can be directly in contact with only one edge from a single other piece, which clearly excludes, in particular, any kind of "joiner" pieces.

A last result of the present invention is to provide an original cutting style, which makes possible to create a variety of new designs, and thus to contribute to the renewal of the art of puzzle design. The number of straight segments, which are part of the cutting lines of the puzzle, is variable, and the arrangement of these straight segments is free, provided they do not define any closed polygonal line nor any polygonal line joining two separate points on the perimeter of the puzzle. These segments are of varying lengths, those of relatively short length ensuring a better stability of the structure of the puzzle, and can be separated from each other or linked together to form angles and broken lines. In the most general case, the different segments are arranged in an irregular way. This arrangement makes possible to design a particularly difficult puzzle to assemble, as no information is given on how the different pieces have to be placed. Alternatively, the different straight segments can be arranged in a regular way, as the result of the repetition of one or more patterns. In this case, the structure of the puzzle shows a greater stability and homogeneity, which can be seen as an advantage. Such an arrangement can be also considered as an additional decorative element, insofar as the cutting lines are clearly visible. All or a part of the straight segments can be also highlighted, either in a direct way, these segments being emphasized with lines forming an integral part of the picture, or in an indirect way, these segments defining the outlines of sections of the picture having different colors.

FIGS. 1 to 7 show different examples illustrating various embodiments of the present invention. On each drawing is shown a puzzle comprising a small number of pieces (80 pieces), for practical reasons. It is clear that each of these drawings could easily be adapted to design a much larger puzzle. Each drawing only shows the perimeter and the cutting lines of the puzzle, and the straight segments, which are part of these cutting lines, have been highlighted with thick strokes, as well as the perimeter of the puzzle.

FIG. 1 shows a first embodiment of the present invention. The puzzle (1) is cut by a number of lines (3) which include a number of straight segments (6). The outer edge pieces (4) which form the border of the puzzle and define its perimeter (2) of rectangular shape, each have either one single straight edge or, for the four corner pieces, two adjacent straight edges. Each of the interior pieces (5) also has, either one single straight edge, or two adjacent straight edges. The straight segments (6) have varying lengths. Some of these segments are separated from each other, the other are linked together to form angles and broken lines. The arrangement of the different segments does not show any visible regularity.

Figure 2:
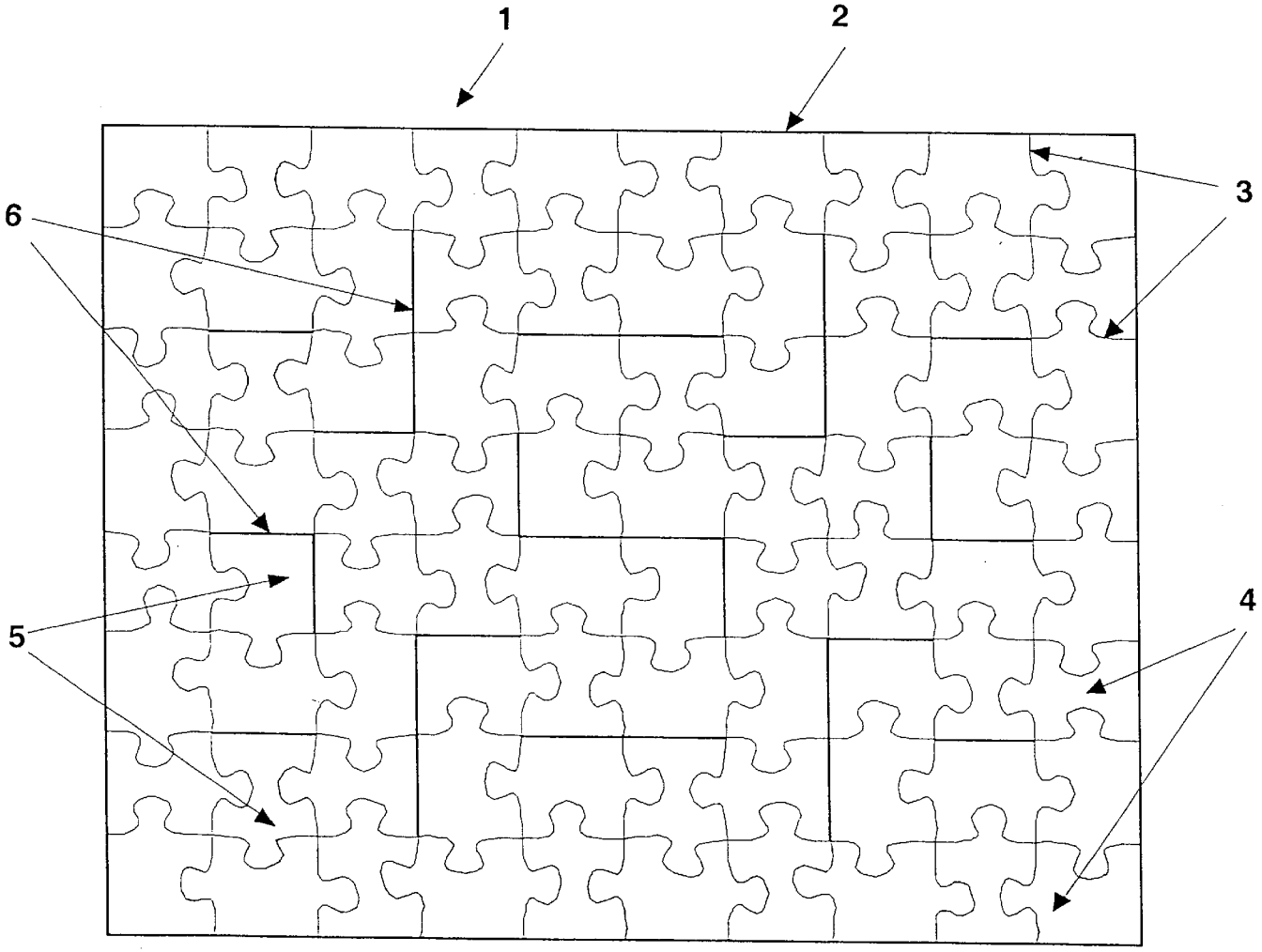
FIG. 2 shows a second embodiment of a puzzle in accordance with the invention.

FIG. 2 shows a second embodiment of the present invention. Unlike FIG. 1, the straight segments (6) are now arranged in a regular way, as a result of the repetition of the same symmetrical pattern, once on the left half of the puzzle, once on the right half.

Figure 3:
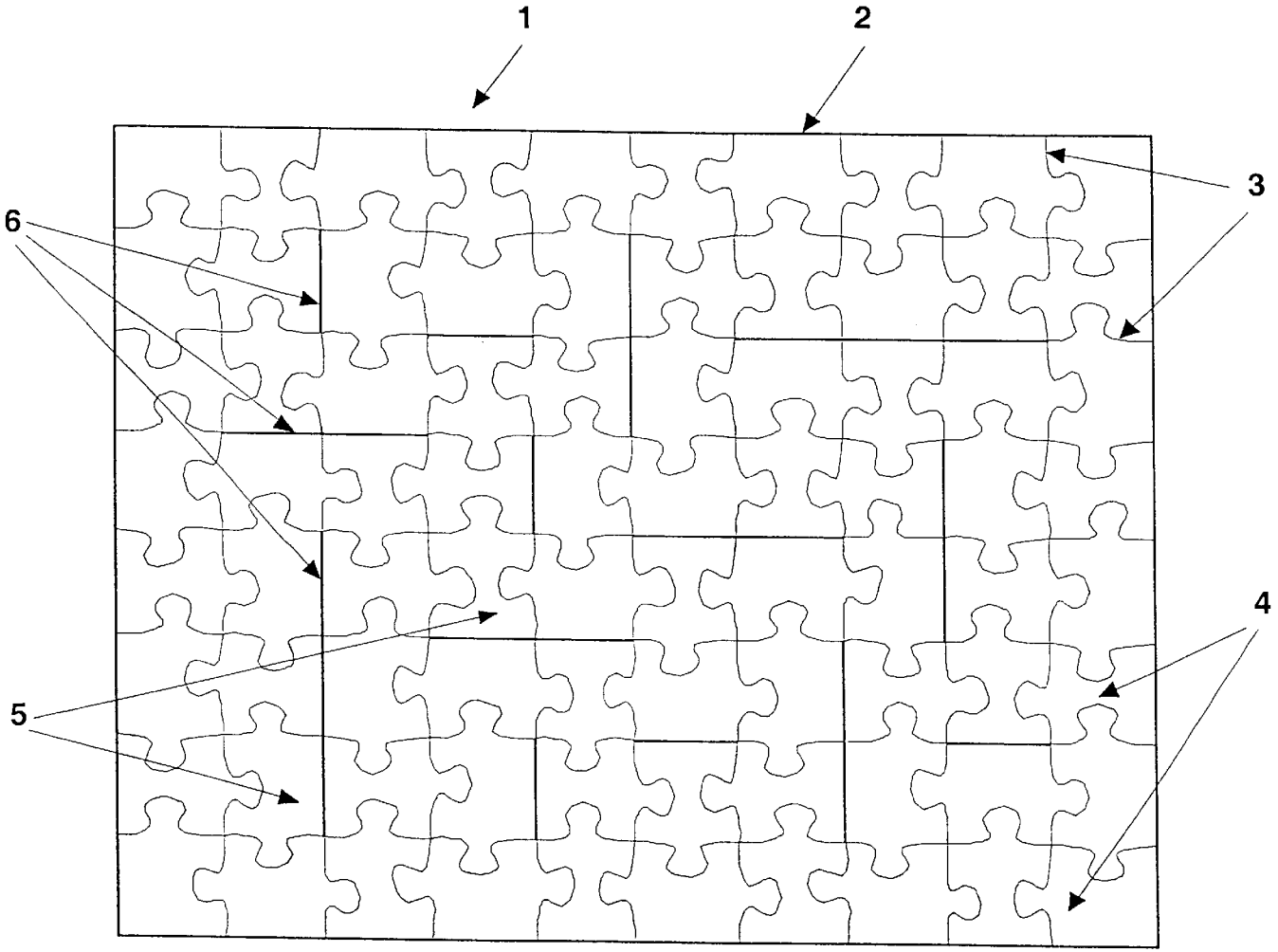
FIG. 3 shows a third embodiment of a puzzle in accordance with the invention.
Figure 4:
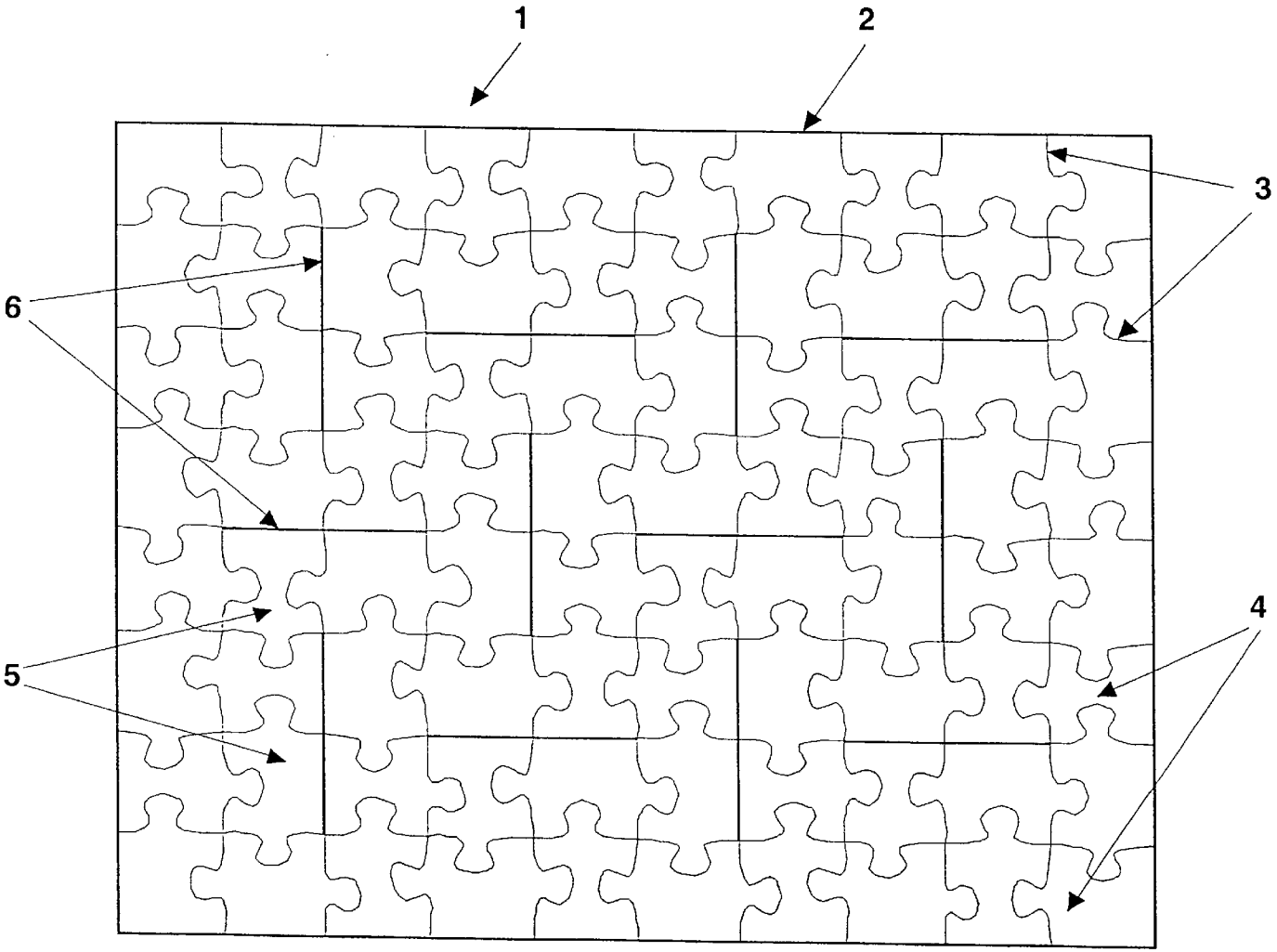
FIG. 4 shows a fourth embodiment of a puzzle in accordance with the invention.
Figure 5:
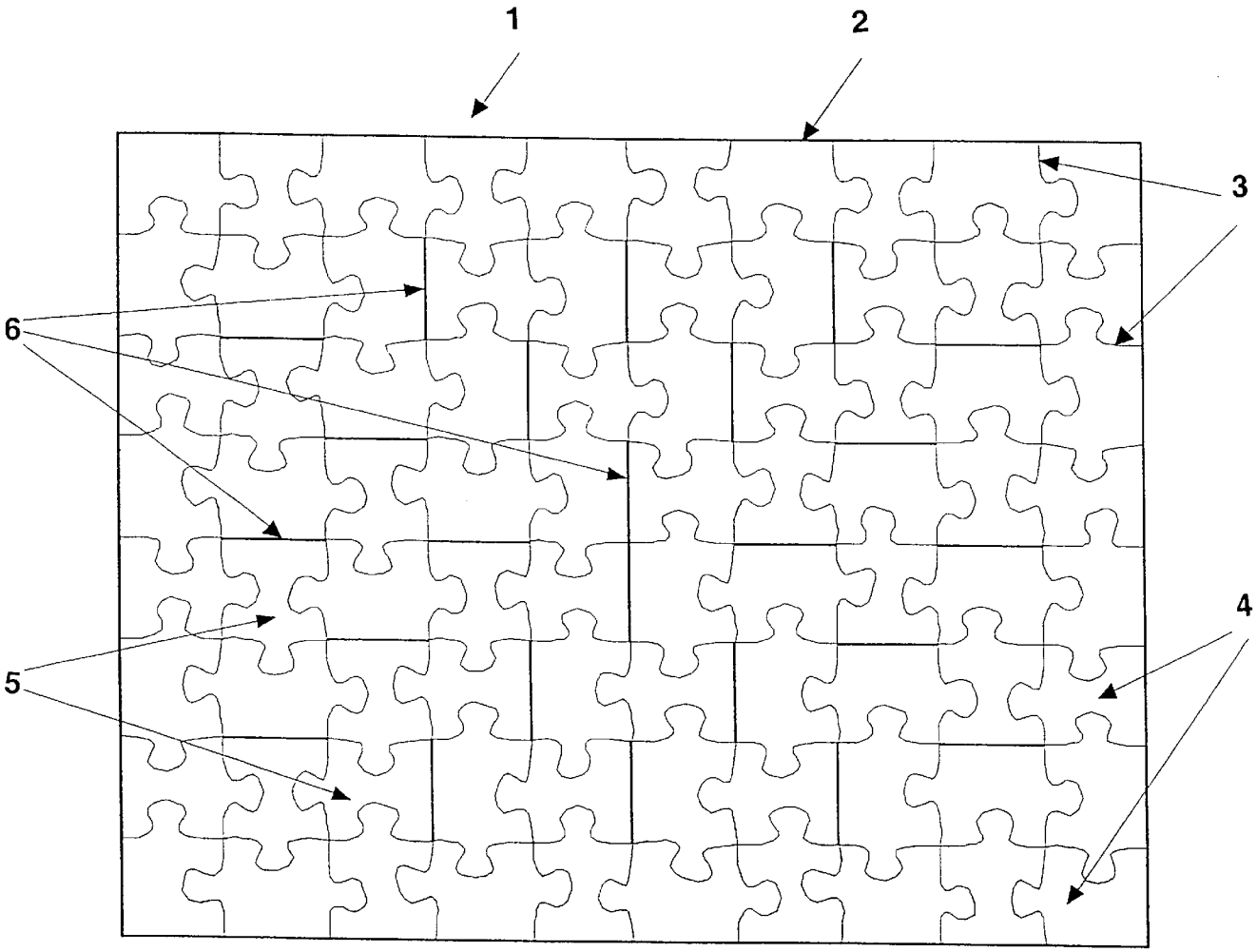
FIG. 5 shows a fifth embodiment of a puzzle in accordance with the invention.

FIGS. 3, 4, and 5 show other embodiments of the present invention. In each of these cases, the interior pieces (5) each have one single straight edge, and the straight segments (6) are separated from each other. In FIG. 3, the straight segments have varying lengths, and the arrangement of these segments does not show any visible regularity. In FIG. 4, the straight segments all have the same length, twice as long as the edge of a piece, and are arranged horizontally and vertically in a regular sequence, as a result of the repetition of a simple pattern, this arrangement showing a clear regularity and homogeneity. In FIG. 5, the straight segments all have the same length, the shortest possible, equal to the length of the edge of a piece, except one single segment in the middle of the puzzle, twice as long as the edge of a piece, the arrangement of these segments showing also a clear regularity and homogeneity. In any of these different cases, it would be easy to extend the different straight segments, or even to add a number of new straight segments, to obtain some interior pieces with several straight edges, for example two adjacent straight edges, like in FIGS. 1 or 2.

Figure 6:
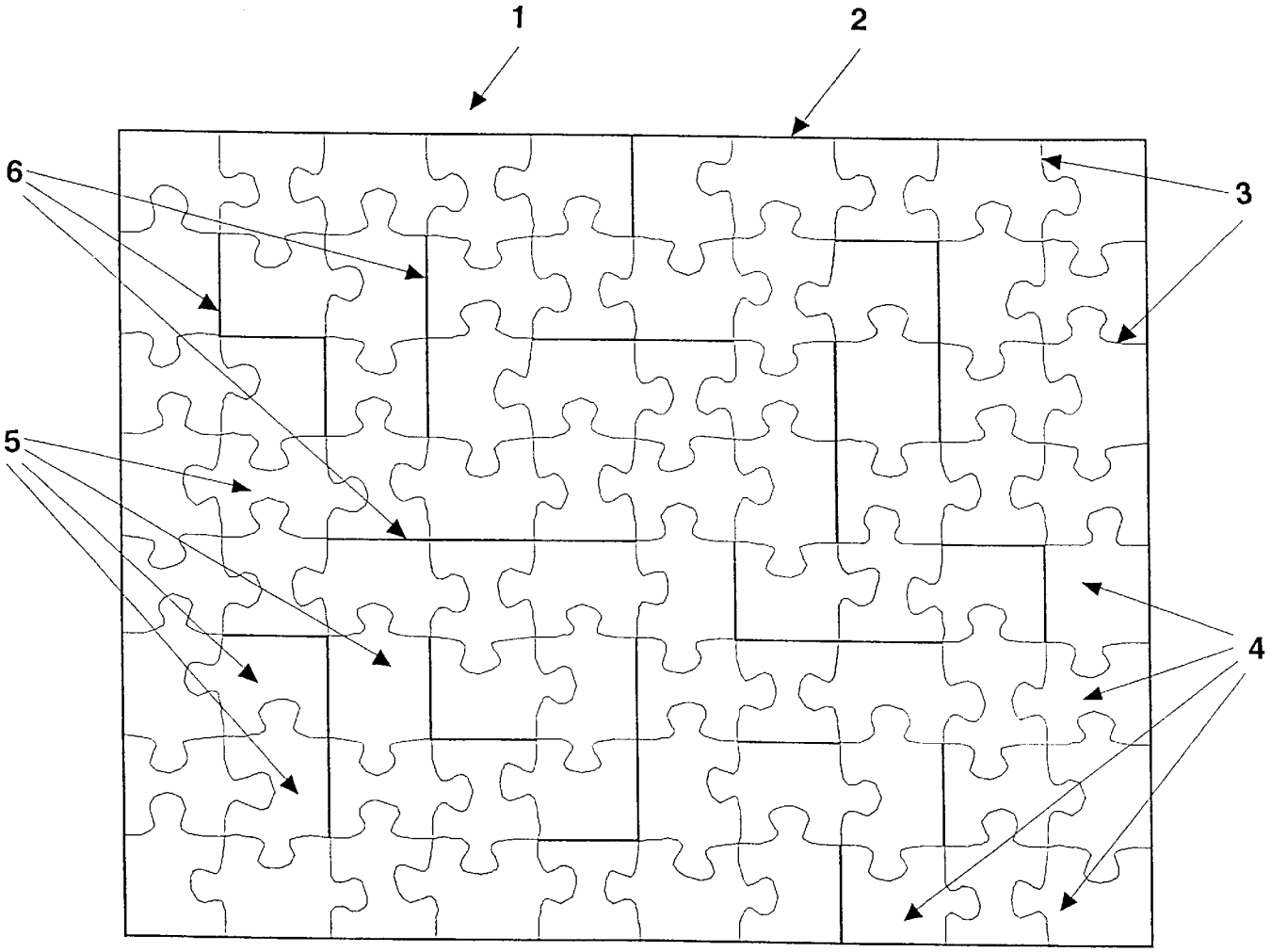
FIG. 6 shows a sixth embodiment of a puzzle in accordance with the invention.

FIG. 6 shows a more general embodiment of the present invention. The outer edge pieces (4) now have either one single straight edge, two opposite straight edges, or two adjacent straight edges, these last pieces being not only the corner pieces of the puzzle. The interior pieces (5) also have, for the most part, either one single straight edge, two opposite straight edges, or two adjacent straight edges. In this case, a small number of interior pieces do not have any straight edge. It would have been possible also to include in such a puzzle a few interior or outer edge pieces having three straight edges. As each piece is necessarily attached by at least one of its edges to one other piece, this would be of course an extreme situation.

Figure 7:
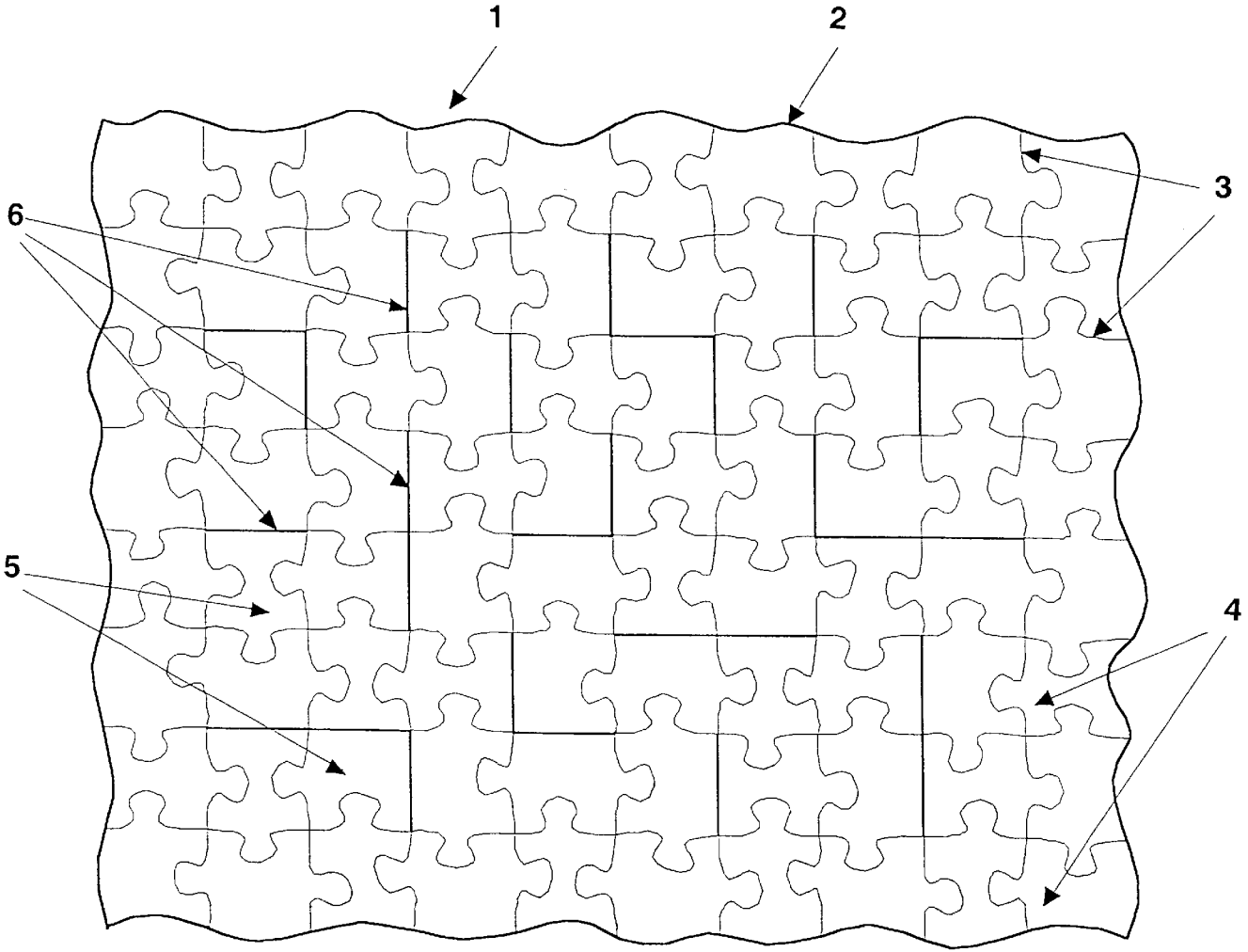
FIG. 7 shows a seventh embodiment of a puzzle in accordance with the invention.

FIG. 7 shows a last embodiment of the present invention. This drawing is similar to FIG. 1, except that the perimeter (2) of the puzzle is now of irregular shape, and that the outer edge pieces (4) do not have any straight edge. This situation, where the only pieces having at least one straight edge are interior pieces, is particularly unusual.

The present invention does not require any modification of the industrial process used to manufacture jigsaw puzzles, and does not involve any particular difficulty, whatever manufacturing technique is chosen. It only requires the creation of a puzzle design according to the characteristics of the invention and, for a conventional manufacturing, the use of an appropriate die.

The present invention, in its different embodiments, applies to puzzles of all kinds having at least the required characteristics, whatever the dimensions of the puzzle, the number and the size of its pieces, the material used to manufacture the puzzle (cardboard, wood, plastic, or any appropriate material), or the thickness of this material. It applies to puzzles having a perimeter of rectangular shape, or of any other shape. It applies to puzzles comprising pieces, all different from each other, or exactly identical in size and shape. It applies to two-sided puzzles, the two sides of the puzzle representing identical or different pictures, and to puzzles made of several layers, opaque or partly transparent, all cut the same way or not. It applies to puzzles representing a totally flat picture or a picture slightly in relief, and to puzzles comprising some interior void portions. It applies to puzzles held in a frame, or held on a support by a magnetic or an adhesive layer, or by any other mechanical means. Finally, it applies to any computer simulation of a puzzle having any of the above characteristics.

The present invention is not limited to the above description and encompasses all possible variations which could be made without departing from its scope and its spirit.

What is claimed is:

1. A jigsaw puzzle comprising a plurality of pieces which can be assembled to form a picture, said pieces including a plurality of outer edge pieces which when assembled establish a perimeter of the puzzle and a plurality of interior pieces, wherein the pieces are formed by cutting the picture along a plurality of cutting lines extending in two approximately orthogonal directions within a plane defined by the puzzle, whereby each piece lies at an intersection of a row and a column and each edge of each piece contacts only one edge from a single other piece in the assembled puzzle;

the pieces are locked together by means of a plurality of male and female interlocking elements, which are part of the edges of the different pieces; and the cutting lines include a variable number of straight segments such that at least half of the interior pieces each have at least one straight edge, said straight segments being arranged in such a way that they do not define any closed polygonal line within the perimeter of the puzzle nor any polygonal line joining two separate points on the perimeter of the puzzle.

2. The jigsaw puzzle as claimed in claim 1, in which all of the pieces of the puzzle, outer edge pieces and interior pieces, each have at least one straight edge.

3. The jigsaw puzzle as claimed in claim 2, in which all of the interior pieces of the puzzle each have either one single straight edge, for a part of these pieces, or two adjacent straight edges forming an angle, for the rest of these pieces.

4. The jigsaw puzzle as claimed in claim 2, in which all of the interior pieces of the puzzle each have one single straight edge.

5. The jigsaw puzzle as claimed in claim 2, in which some outer edge pieces have at least one interior straight edge which makes contact with an edge from an interior or outer edge adjacent piece.

6. The jigsaw puzzle as claimed in claim 2, in which the straight segments are arranged in a regular way, as a result of the repetition of one or more patterns.

7. The jigsaw puzzle as claimed in claim 2, in which all or part of the straight segments are highlighted, either in a direct way, these segments being emphasized with lines forming an integral part of the picture, or in an indirect way, these segments defining the outlines of sections of the picture having different colors.

8. The jigsaw puzzle as claimed in claim 1, in which all of the interior pieces of the puzzle each have at least one straight edge.

9. The jigsaw puzzle as claimed in claim 8, in which all of the interior pieces of the puzzle each have either one single straight edge, for a part of these pieces, or two adjacent straight edges forming an angle, for the rest of these pieces.

10. The jigsaw puzzle as claimed in claim 8, in which all of the interior pieces of the puzzle each have one single straight edge.

11. The jigsaw puzzle as claimed in claim 8, in which some outer edge pieces have at least one interior straight edge which makes contact with an edge from an interior or outer edge adjacent piece.

12. The jigsaw puzzle as claimed in claim 8, in which the only puzzle pieces having at least one straight edge are interior pieces.

13. The jigsaw puzzle as claimed in claim 8, in which the straight segments are arranged in a regular way, as a result of the repetition of one or more patterns.

14. The jigsaw puzzle as claimed in claim 8, in which all or part of the straight segments are highlighted, either in a direct way, these segments being emphasized with lines forming an integral part of the picture, or in an indirect way, these segments defining the outlines of sections of the picture having different colors.

15. The jigsaw puzzle as claimed in claim 1, in which some outer edge pieces have at least one interior straight edge which makes contact with an edge from an interior or outer edge adjacent piece.

16. The jigsaw puzzle as claimed in claim 1, in which the only puzzle pieces having at least one straight edge are interior pieces.

17. The jigsaw puzzle as claimed in claim 1, in which the straight segments are arranged in a regular way, as a result of the repetition of one or more patterns.

18. The jigsaw puzzle as claimed in claim 1, in which all or part of the straight segments are highlighted, either in a direct way, these segments being emphasized with lines forming an integral part of the picture, or in an indirect way, these segments defining the outlines of sections of the picture having different colors.

19. A method for forming a jigsaw puzzle from a picture having a perimeter and an interior comprising the step of cutting the picture into a plurality of pieces along a plurality of cutting lines extending in two approximately orthogonal directions within a plane defined by the support, whereby each piece lies at an intersection of a row and a column and each edge of each piece contacts only one edge from a single other piece in the assembled puzzle, wherein the cutting lines include a variable number of straight segments and a variable number of non-straight segments, such that at least half of the pieces in the interior of the picture each have at least one straight edge and each piece interlocks with at least one other piece, said straight segments being arranged in such a way that they do not define any closed polygonal line within the perimeter of the puzzle nor any polygonal line joining two separate points on the perimeter of the puzzle.

* * * * *